US009974372B1

(12) United States Patent
Lohse

(10) Patent No.: US 9,974,372 B1
(45) Date of Patent: May 22, 2018

(54) HAIRPIN

(71) Applicant: Colleen M. Lohse, Ladera Ranch, CA (US)

(72) Inventor: Colleen M. Lohse, Ladera Ranch, CA (US)

( * ) Notice: Subject to any disclaimer, the term of this patent is extended or adjusted under 35 U.S.C. 154(b) by 0 days. days.

(21) Appl. No.: 15/610,506

(22) Filed: May 31, 2017

(51) Int. Cl.
*A45D 8/08* (2006.01)

(52) U.S. Cl.
CPC ..... *A45D 8/08* (2013.01)

(58) Field of Classification Search
CPC ... A45D 8/02; A45D 8/06; A45D 8/08; A45D 8/10; A45D 8/14; A45D 8/16; Y10T 24/3485; Y10T 24/1394
See application file for complete search history.

(56) References Cited

U.S. PATENT DOCUMENTS 562,690 A 6/1896 Young
565,255 A 8/1896 Belden
709,255 A 9/1902 Bechtold
722,260 A 3/1903 Sloan
742,892 A * 11/1903 McGill ..... B42F 1/08 24/547
848,048 A 3/1907 Pryce-Jones
910,715 A 1/1909 Needs
935,969 A 10/1909 Dunbar
1,256,005 A 2/1918 Focha
1,272,209 A 7/1918 Burke
1,281,469 A 10/1918 Wood
1,305,309 A 6/1919 Rollason
1,337,039 A 4/1920 Bruder
1,337,377 A * 4/1920 Wilson ..... A45D 8/08 132/280
1,392,374 A * 10/1921 Walker ..... A45D 8/08 132/281
1,516,294 A * 11/1924 Hubeny ..... B42F 1/08 24/547
1,594,933 A 8/1926 Durand
1,605,433 A 11/1926 Gibson
1,608,790 A 11/1926 Henslow
1,618,385 A 2/1927 Pearson
1,711,908 A * 5/1929 Smith ..... A45D 8/06 132/281

(Continued)

FOREIGN PATENT DOCUMENTS

GR 551622 * 5/1932

*Primary Examiner* — Todd E Manahan
*Assistant Examiner* — Brianne Kalach
(74) *Attorney, Agent, or Firm* — Jafari Law Group, Inc.

(57) ABSTRACT

The invention involves an improved hairpin formed of a wire having two terminal ends and a series of bends that define differently situated prongs for securing a hairstyle of a wearer. In exemplary embodiments, a first prong may be defined by a first leg and a second leg that extend from a first u-shaped bend. A second prong may be defined by the first leg and a third leg that extends from a second u-shaped bend situated opposite to the first u-shaped bend. Moreover, a third prong may be defined by the second leg and a fourth leg extending from a third u-shaped bend situated opposite to the first u-shaped bend, wherein the first u-shaped bend, the second u-shaped bend and the third u-shaped bend are situated on a single plane and the first leg, the second leg, the third leg and the fourth leg are substantially parallel.

12 Claims, 8 Drawing Sheets

(56) References Cited

U.S. PATENT DOCUMENTS

| | | | | | |
|---|---|---|---|---|---|
| 2,031,484 | A | | 2/1936 | Interrante | |
| 2,056,139 | A | * | 9/1936 | Kelly | B42F 1/08 24/547 |
| 2,075,194 | A | | 3/1937 | Gibson | |
| 2,254,013 | A | | 8/1941 | Larson | |
| 2,522,911 | A | | 8/1950 | Weaver | |
| 2,584,637 | A | | 2/1952 | Sprinkle | |
| 2,664,899 | A | | 1/1954 | Attias | |
| 2,843,408 | A | | 7/1958 | Stukenborg | |
| 3,039,647 | A | | 7/1962 | Rasmussen | |
| 3,194,248 | A | | 7/1965 | Callies | |
| 3,330,287 | A | | 7/1967 | Muhs | |
| 3,540,491 | A | | 11/1970 | Solomon | |
| 3,741,592 | A | | 6/1973 | Muncy | |
| 3,822,446 | A | | 7/1974 | Silverstein | |
| 3,930,511 | A | * | 1/1976 | Roney | A45D 8/14 132/284 |
| 4,107,824 | A | | 8/1978 | Lussier | |
| 4,148,114 | A | * | 4/1979 | Wier | B42F 1/02 24/564 |
| 4,301,575 | A | | 11/1981 | Goldberg | |
| 4,324,025 | A | | 4/1982 | Apri | |
| 4,909,466 | A | | 3/1990 | Matthews | |
| 5,092,668 | A | | 3/1992 | Welch | |
| 5,097,567 | A | | 3/1992 | Glaus | |
| 5,584,456 | A | | 2/1996 | Stephens | |
| D368,150 | S | | 9/1996 | Pereira | |
| 5,639,231 | A | | 6/1997 | May | |
| 5,718,026 | A | | 2/1998 | Harrison | |
| 5,855,403 | A | | 1/1999 | Harper | |
| 5,913,341 | A | | 6/1999 | Jones | |
| 6,014,794 | A | | 1/2000 | McCoy | |
| 6,038,743 | A | | 3/2000 | Chapman | |
| 6,386,604 | B1 | | 5/2002 | Scanlon | |
| 6,413,266 | B1 | | 7/2002 | Mason | |
| 6,460,547 | B1 | * | 10/2002 | Williams | A45D 8/02 132/280 |
| 7,007,367 | B2 | | 3/2006 | Ferguson | |
| D532,872 | S | | 11/2006 | Miyamoto | |
| 7,827,999 | B2 | | 11/2010 | Tu | |
| D635,297 | S | | 3/2011 | Hsu | |
| 7,987,720 | B2 | | 7/2011 | Tu | |
| D663,070 | S | | 7/2012 | McNally | |
| D702,399 | S | | 4/2014 | Mosley | |
| 9,210,280 | B2 | | 12/2015 | Kowalski | |
| 2006/0174909 | A1 | | 8/2006 | Vestal | |
| 2007/0256702 | A1 | * | 11/2007 | Traver | A45D 8/06 132/280 |
| 2008/0185015 | A1 | | 8/2008 | Tu | |
| 2009/0255551 | A1 | | 10/2009 | Taylor | |
| 2010/0319168 | A1 | | 12/2010 | Wu | |
| 2012/0180805 | A1 | | 7/2012 | Conway | |
| 2013/0025623 | A1 | | 1/2013 | Herzog | |
| 2014/0069789 | A1 | | 4/2014 | Caruso | |
| 2015/0096586 | A1 | | 4/2015 | Sonstegard | |
| 2015/0230578 | A1 | | 8/2015 | Sze | |
| 2016/0278497 | A1 | | 9/2016 | Sonstegard | |

* cited by examiner

HAIRPIN

TECHNICAL FIELD OF THE INVENTION

The present invention relates generally to an improved hairpin. More specifically, the present invention relates to a hairpin with an improved design that secures the hair of a wearer in a manner that preserves the wearer's hair style during more strenuous activities and for a prolonged period of time.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Hairpins and their use is well known and commonly disclosed in the prior art. Moreover, this crowded art offers various shapes and sizes for addressing widely different objectives. Some of these prior art devices have designs comprising clips that clamp on to the hair. Other designs, have features and characteristics that include moving components designed to secure parts of the hairpin against each other. Typically, hairpins comprise a single component, but some designs comprise several interacting components.

Examples of known prior art hairpins include U.S. Pat. No. 6,460,547 to Williams, which discloses a hairpin for gripping and placing the hair of a user against the head of the user. The hairpin is constructed from a strand of wire formed from a resilient material having a first leg and a second leg joined together by a first bend. The first leg has a second bend disposed near a free end of the first leg, such that a third leg is defined between the second bend and the free end of the first leg. A total length of the first and third legs is generally equal to a length of the second leg. The first, second and third legs lying generally in the same plane. The third leg is a smaller leg for allowing a user to handle the hairpin while the first and second legs are used to secure the hairpin to the user's hair.

Another example of known hairpins includes U.S. Patent Publication 2007/0256702 to Traver et al., which discloses an apparatus that includes a first arm, a second arm, a first locking member, and a second locking member interconnected to one another to form a space for receiving hair and to secure the hair within the space. The first locking member and the second locking member may be overlapped to close an opening and secure the hair within the space.

Yet another example includes U.S. Pat. No. 1,594,933 to Durand, which discloses a hairpin having one end formed into a loop, and having two opposite members substantially parallel to each other and implementing a leg turned backwards into a hook parallel with an axis of the leg.

Yet another example includes U.S. Patent Publication 2006/01744909 to Vestal et al., which discloses a hair pin that includes a first leg, a second leg, and opening, and a connecting portion connecting the first and second legs at their respective second ends. The first leg including a first set of undulations extending over a majority of the first leg, and the second leg including a second set of undulations extending over a majority of the second leg. The opening is disposed between first ends of the first and second legs and receives strands of hair when the hair pin is in an open position.

Other known examples include: U.S. Pat. No. 2,664,899 to Attias; U.S. Pat. No. 3,194,248 to Callies; and U.S. Pat. No. 1,337,377 to Wilson.

Known devices such as those briefly described above, offer different alternatives at securing a wearer's hair, but each has one or more shortcomings. For example, some of these devices are configured to clip securely onto themselves, which may facilitate a locking means, but are often unreasonably difficult to place within the wearer's hair. Moreover, such complicated hairpins are typically expensive to manufacture. Other designs don't accommodate a variety of hairstyles because of their particular structure. Yet other designs have structural features that actually damage the hair by, for example, unnecessarily pulling on the wearer's hair strands. Most problematic, is that prior art hairpins do not secure a wearer's hairstyle during prolonged periods of time, especially during which a wearer may be active—for example during activities such as dancing, prolonged formal events, etc.

Therefore, there exists a previously unappreciated or inadequately-met need for a new and improved hairpin that: secures the hair of a wearer in a manner that preserves the wearer's hair style during more strenuous activates; secures the hair of a wearer in a manner that preserves the wearer's hair style for a prolonged period of time; is easily placed within a wearer's hair; does not unnecessarily damage a wearer's hair while being placed therein, and or during use of the hairpin; and may be manufactured efficiently and in an inexpensive manner. It is to these ends that the present invention has been developed.

SUMMARY OF THE INVENTION

To minimize the limitations in the prior art, and to minimize other limitations that will be apparent upon reading and understanding the present specification, the present invention describes a hairpin with an improved design that secures the hair of a user in manner that preserves the user's hair style for a prolonged period of time.

Generally, the invention involves a hairpin that in exemplary embodiments may be formed of a wire having two terminal ends and a series of bends that define differently situated prongs for securing a hairstyle of a wearer. The various embodiments of an improved hairpin, in accordance with the present invention, provide a set of prongs that are configured to weave into the hair of a user and securely stay in place. Because the set of multiple prongs are situated in generally opposing directions, the improved hairpins hold their position within a wearer's hairstyle more securely than prior art hairpins. The positioning of the prongs allows each hairpin to be placed inside or within a wearer's hair with ease and without damage to the hair or scalp of a user. Furthermore, as will become apparent below, exemplary embodiments have prong configurations that enable each hairpin to receive (and securely hold onto) various levels of multiple strands of hair, which generally improve the overall holding factor of each improved hairpin.

In exemplary embodiments, a first prong may be defined by a first leg and a second leg that extend from a first u-shaped bend. A second prong may be defined by the first leg and a third leg that extends from a second u-shaped bend situated opposite to the first u-shaped bend. Moreover, a third prong may be defined by the second leg and a fourth leg extending from a third u-shaped bend situated opposite to the first u-shaped bend, wherein the first u-shaped bend, the second u-shaped bend and the third u-shaped bend are generally situated on a similar plane and the first leg, the second leg, the third leg and the fourth leg are substantially parallel and also situated on the same plane or multiple planes depending on the various embodiments of the invention.

Accordingly, a hairpin, in accordance with an exemplary embodiment of the present invention, is typically formed of a wire having two terminal ends, and comprises: a first prong defined by a first leg and a second leg extending from a first u-shaped bend on the wire; a second prong defined by the first leg and a third leg extending from a second u-shaped bend situated opposite to the first u-shaped bend, the third leg terminating at a first terminal end of the wire; and a third prong defined by the second leg and a fourth leg extending from a third u-shaped bend situated opposite to the first u-shaped bend, the fourth leg terminating at a second terminal end of the wire, wherein: the first u-shaped bend, the second u-shaped bend and the third u-shaped bend are situated on a single plane; and the first leg, the second leg, the third leg and the fourth leg are substantially parallel and situated on the single plane.

In another exemplary embodiment, a hairpin formed of a wire having two terminal ends, comprises: a first prong defined by a first leg and a second leg extending from a first bend on said wire; a second prong defined by the first leg and a third leg extending from a second bend situated opposite to the first bend, the third leg terminating at a first terminal end of the wire; and a third prong defined by the second leg and a fourth leg extending from a third bend situated opposite to the first bend, the fourth leg terminating at a second terminal end of the wire, wherein the first bend, the second bend and the third bend are situated on a single plane.

In yet another embodiment, a hairpin formed of a wire having two terminal ends, comprises: a first prong defined by a first leg including a first wavy region and a second leg including a second wavy region, the first leg and the second leg extending from a first u-shaped bend on said wire, a length of the second leg greater than a length of the first leg; a second prong defined by the first leg and a third leg extending from a second u-shaped bend situated opposite to the first u-shaped bend, the third leg including a third wavy region and a first terminal end of the wire; and a third prong defined by the second leg and a fourth leg extending from a third u-shaped bend situated opposite to the first u-shaped bend, the fourth leg including a fourth wavy region and a second terminal end of the wire, wherein: the first u-shaped bend, the second u-shaped bend and the third u-shaped bend are situated on a single plane; the first leg, the second leg, the third leg and the fourth leg are substantially parallel and situated on the single plane; and a distance from a vertex of the second u-shaped bend to a vertex of the first u-shape bend is less than a distance from a vertex of the third u-shaped bend to the vertex of the first u-shape bend.

It is an objective of the present invention to provide an improved hairpin that secures the hair of a user in a manner that preserves the user's hair style during more strenuous activities.

It is another objective of the present invention to provide an improved hairpin that preserves the user's hair style for a prolonged period of time.

It is yet another objective of the present invention to provide an improved hairpin that is easily placed within a user's hair.

It is yet another objective of the present invention to provide an improved hairpin that does not unnecessarily damage a user's hair while being placed therein or during use.

It is yet another objective of the present invention to provide a hairpin that may be manufactured efficiently and inexpensively.

These advantages and features of the present invention are not meant as limiting objectives, but are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. The drawings that accompany the detailed description can be briefly described as follows:

FIG. 1(*b*) illustrates a side view of the hairpin depicted in FIG. 1(*a*).

FIG. 1(*c*) illustrates a cross-sectional view along line B depicted in FIG. 1(*a*) in accordance with an exemplary embodiment.

FIG. 1(*d*) illustrates a cross-sectional view along line B depicted in FIG. 1(*a*), in accordance with an alternative exemplary embodiment.

FIG. 2(*b*) illustrates a top view of a hairpin in accordance with an exemplary embodiment of the present invention similar to the embodiment shown in FIG. 2(*a*).

FIG. 3(*b*) illustrates a top view of a hairpin in accordance with an exemplary embodiment of the present invention similar to the embodiment shown in FIG. 3(*a*).

FIG. 4(*b*) illustrates a top view of a hairpin in accordance with an exemplary embodiment of the present invention similar to the embodiment shown in FIG. 4(*a*).

FIG. 6(*b*) illustrates a side view of the hairpin depicted in FIG. 6(*a*).

DETAILED DESCRIPTION OF THE INVENTION

Figure 1A:
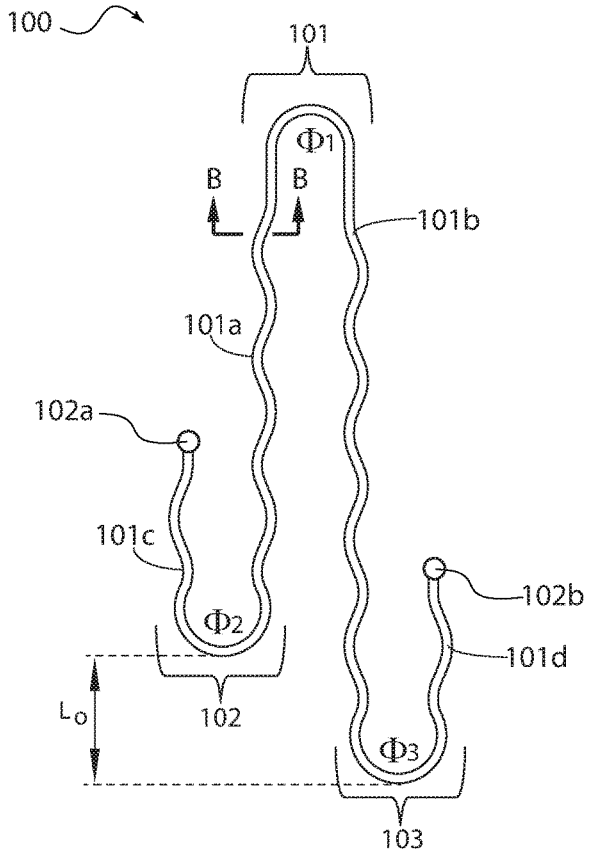
FIG. 1(*a*) illustrates a top view of a hairpin in accordance with one exemplary embodiment of the present invention.
Figure 1B:
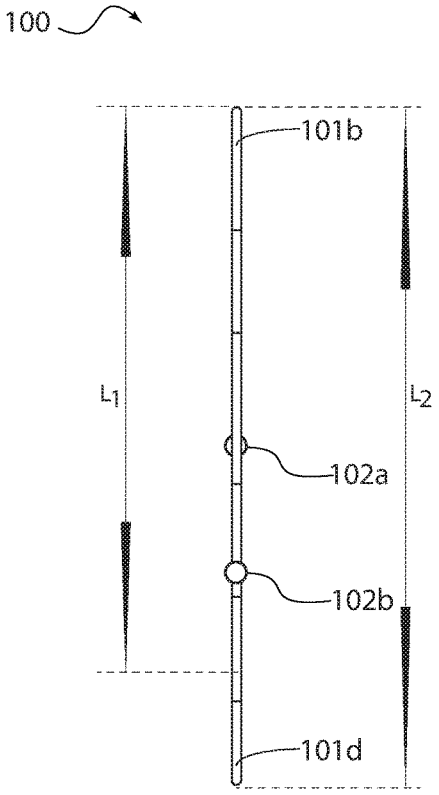
Figure 1C:
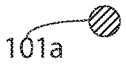
Figure 1D:
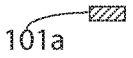

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention. Wherever possible, the same reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims.

Turning now to the figures, FIG. 1(*a*) illustrates a top view of a hairpin in accordance with one exemplary embodiment of the present invention. More specifically, FIG. 1(*a*) depicts hairpin 100, which may be constructed of a single wire having two terminal ends 102*a* and 102*b* including several bends and several legs that form several prongs for securing a wearer's hair. In the illustrated embodiment, hairpin 100 includes three bends $\Phi_1$, $\Phi_2$, and $\Phi_3$, which correspond to three distinct prongs 101, 102 and 103, respectively.

As depicted in FIG. 1(*a*), in an exemplary embodiment, a hairpin formed of a wire having two terminal ends may comprise a first prong 101 defined by a first leg 101*a* including a first wavy region and a second leg 101*b* including a second wavy region. Although not necessary, wavy regions facilitate receiving and guiding hair strands through the openings or gaps within each of the prongs. The first leg 101*a* and the second leg 101*b* may extend from a first u-shaped bend $\Phi_1$ on said wire. Although other alternatives will be discussed in more detail below with reference to other figures, in the present embodiment, a length of the second leg 101*b* may be greater than a length of the first leg 101*a*.

Hairpin 100 further comprises a second prong 102, which may be defined by the first leg 101*a* and a third leg 101*c*, which extend from a second u-shaped bend $\Phi_2$ situated opposite to the first u-shaped bend $\Phi_1$, meaning that each of the legs 101*c* and 101*a* extend towards u-shaped bend $\Phi_1$ from u-shaped bend $\Phi_2$. Typically, the third leg 101*c* includes a third wavy region and terminates at the first terminal end 102*a* of the wire.

Hairpin 100 further comprises a third prong 103, which may be defined by the second leg 101*b* and a fourth leg 101*d*, which extend from a third u-shaped bend $\Phi_3$ situated opposite to the first u-shaped bend $\Phi_1$, meaning that each of the legs 101*b* and 101*d* extend towards u-shaped bend $\Phi_1$ from u-shaped bend $\Phi_3$. Mirroring prong 101 and prong 102, the fourth leg 101*d* of prong 103 includes a fourth wavy region and terminates at the second terminal end 102*b* of the wire.

In exemplary embodiments, the u-shaped bend $\Phi_1$, u-shaped bend $\Phi_2$ and u-shaped bend $\Phi_3$ are situated on a single plane, and thus all three pongs 101, 102 and 103 are similarly situated on the same plane so that the wire or body of hairpin 100 may lay substantially flat against a surface, albeit any wavy regions designs that may raise the body of the hairpin. Notably, as shown in FIG. 1(*a*) and FIG. 1(*b*), the wavy regions or wavy structure implemented along the lengths of each of the legs is accomplished horizontally—hence hairpin 100 as exemplarily shown may lay substantially flat against a surface. Alternatively, however, each wavy structure may be vertically orientated or orientated in a manner that alternates, which may prevent hairpin 100 from laying completely flat on a surface, without deviating from the scope of the present invention. Moreover, leg 101*a*, leg 101*b*, leg 101*c* and leg 101*d* may be substantially parallel and situated on the same plane as well.

In the shown exemplary embodiment, as mentioned above, a length of leg 101*b* is greater than a length of leg 101*a*; thus, a distance from a vertex of u-shaped bend $\Phi_2$ to a vertex of u-shape bend $\Phi_1$ is less than a distance from a vertex of u-shaped bend $\Phi_3$ to the vertex of u-shape bend $\Phi_1$. This configuration allows hairpin 100 to secure to a user's hair by grasping or receiving various levels of hair strands, as will be discussed further with reference to FIG. 7 and FIG. 8 below, more so than other configurations in which the first and second legs are equal in length.

Typically, although not necessarily, a length of leg 101*c* is less than half a length of leg 101*a*, and a length of leg 101*d* is less than half a length of leg 101*b*. In exemplary embodiments, less than half means approximately or substantially 45% of the length of the adjacent leg. Although other measurements or length rations would not deviate from the scope of the present invention, this length relationship maximizes the holding factor of a hairpin in accordance with the present invention.

FIG. 1(*b*) illustrates a side view of hairpin 100, where this exemplary characteristic may be appreciated. One benefit of this characteristic is that more hair may be secured within the prongs; another more unexpected benefit however is that the hair is easier to guide through the prong when the length of the leg is as such—particularly so when prong 102 and prong 103 are offset by a height or length $L_0$. For example, and without limiting the scope of the present invention, a first length $L_1$ running from a terminal end of prong 102 (i.e. at the base of u-shaped bend $\Phi_2$) to a terminal end of prong 101 (i.e. the top portion of u-shaped bend $\Phi_1$), may be less than a second length $L_2$ running from the terminal end of prong 103 (i.e. the base portion of u-shaped bend $\Phi_3$) to a terminal end of prong 101 (i.e. the top portion of u-shaped bend $\Phi_1$).

In this exemplary embodiment, the first terminal end 102*a* and the second terminal end 102*b* are situated outside prong 101 so that each terminal end is situated external to a center region of the hairpin 100 that is defined between the first leg 101*a* and the second leg 101*b*. As will be discussed further below, other alternative configurations are possible without deviating from the scope of the present invention. (See for example FIG. 3(*a*)-FIG. 4(*b*)).

Although the present embodiment is shown implementing a wavy region throughout or along a length of each of the first leg 101*a*, the second leg 101*b*, the third 101*c* and the fourth leg 101*d*, other embodiments may not include any wavy regions or wavy sections, or only smaller lengths of wavy sections, without deviating from the scope of the invention.

Typically, the wire may be constructed of any suitable material such as a resilient yet malleable metal or soft alloy that is preferably easy to bend, but that is durable enough for multiple uses without easily breaking apart—especially since wearers, hairdressers or users in general utilizing a device in accordance with the present invention may bend and unbend portions of hairpin 100 several times.

Without limiting the scope of the present invention, in exemplary embodiments, hairpin 100 comprises a resilient yet malleable or easily bendable stainless-steel wire. Similarly, hairpin 100's wire may be of any size without deviating from the scope of the present invention. In one exemplary embodiment, a length between a terminal end of prong 101 and a terminal end of prong 103 is 3 inches; in another exemplary embodiment, the length $L_2$ between a terminal end of prong 101 and a terminal end of prong 103 is 2½ inches; in yet another exemplary embodiment, the length between a terminal end of prong 101 and a terminal end of prong 103 is 1½ inches; in yet another exemplary embodiment, the length between a terminal end of prong 101 and a terminal end of prong 103 is 1 inch; in yet another exemplary embodiment, the length between a terminal end of prong 101 and a terminal end of prong 103 is ¾ of an inch. Similarly, various thicknesses for the wire of hairpin 100 may be implemented, however, preferably the wire thickness does not interfere with the malleability of the wire so that users may easily bend the legs as required while placing the hairpin in place or removing the hairpin from the wearer, or otherwise adjusting a width of an opening (i.e. an angle of one of the u-shaped bends for example) of one of the prongs.

In exemplary embodiments, the wire includes an anti-slip surface. This characteristic may be advantageous to allow users to easily handle and grip the hairpin without slippage. As is well known, different methods for providing an anti-slip surface maybe implemented, including but not limited to dipping the wire in known compositions or implementing anti-slip coatings or other protective coatings that help preserve the wire of the hairpin.

As may be appreciated from the figures, terminal ends 102*a* and 102*b* are rounded terminal ends. Although not necessary, rounded terminal ends help protect the wearer from damaging their hair or accidentally scraping their scalp. The rounded terminal ends may be, without limitation, additional components added to the wire such as a rounded coating that is added to the wire's terminal end, or simply a rounded wire end that has been polished, filed, or otherwise formed by shaping the terminal end of the wire. Notably, while in certain embodiments (for example those shown in FIG. 1(*a*), or FIG. 4(*a*)) unrounded terminal ends are not as detrimental, in other embodiments such as that depicted in FIG. 5, rounded terminal ends may be more useful from a safety perspective.

The wire itself may also comprise different shapes without deviating from the scope of the invention. FIG. 1(*c*) illustrates a cross-sectional view along line B depicted in FIG. 1(*a*) in accordance with an exemplary embodiment. In such exemplary embodiment, the wire comprises a rounded cross-section. This embodiment provides a generally smooth surface for users to hold on to when using the device. FIG. 1(*d*) illustrates a cross-sectional view along line B depicted in FIG. 1(*a*), in accordance with an alternative exemplary embodiment. In such exemplary embodiment, the wire comprises a polygonal cross-section. A polygonal cross-section may include, without limitation, a rectangular cross-section (as shown) or any other multi-sided surface such as hexagonal, octagonal, etc.

Figure 2A:
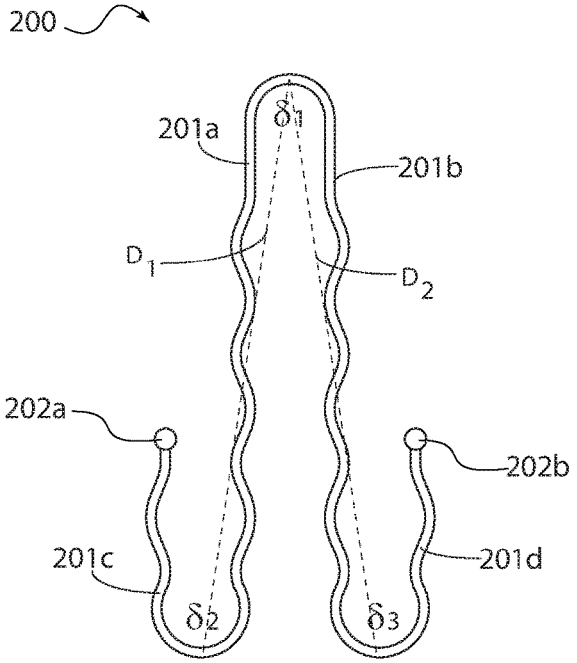
FIG. 2(*a*) illustrates a top view of a hairpin in accordance with one exemplary embodiment of the present invention.
Figure 2B:
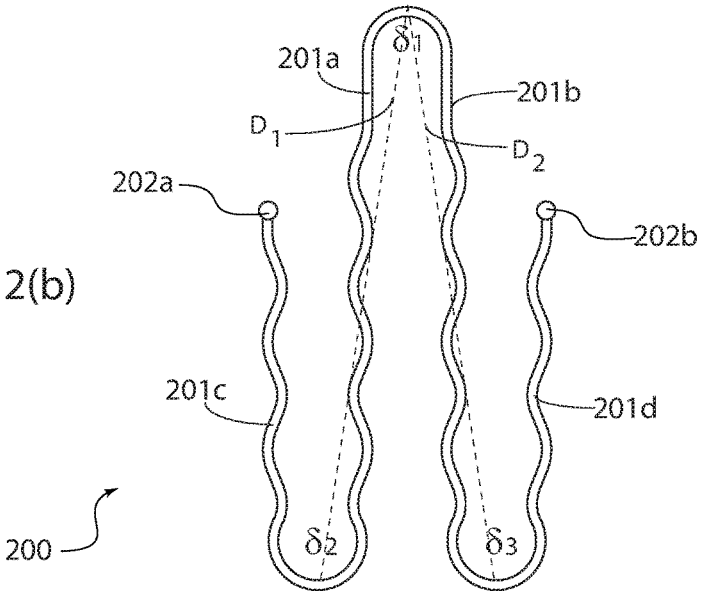

Turning now to the next two figures, FIG. 2(*a*) and FIG. 2(*b*) illustrate a top view of a hairpin in accordance with another two similar exemplary embodiments in accordance with the present invention. More specifically, FIG. 2(*a*) shows a hairpin formed of a wire having two terminal ends, comprising: a first prong defined by a first leg 201*a* and a second leg 201*b* extending from a first u-shaped bend $\delta_1$ on the wire; a second prong defined by the first leg 201*a* and a third leg 201*c* extending from a second u-shaped bend 62 situated opposite to the first u-shaped bend $\delta_1$, the third leg 201*c* terminating at a first terminal end 202*a* of the wire; and a third prong defined by the second leg 201*b* and a fourth leg 201*d* extending from a third u-shaped bend $\delta_3$ situated opposite to the first u-shaped bend $\delta_1$, the fourth leg 201*d* terminating at a second terminal end 202*b* of the wire.

In these embodiments, the first u-shaped bend $\delta_1$, the second u-shaped bend 62 and the third u-shaped bend $\delta_3$ are situated on the same plane; and the first leg 201*a*, the second leg 201*b*, the third leg 201*c* and the fourth leg 201*d* are substantially parallel and also situated on the same plane.

In the shown exemplary embodiments, a length of the first leg 201*a* is substantially equal to a length of the second leg 201*b* so that a vertex of the second u-shaped bend $\delta_2$ and a vertex of the third u-shaped bend $\delta_3$ are substantially equidistant from a vertex of the first u-shaped bend $\delta_1$. Accordingly, in the shown embodiments, a distance $D_1$ is substantially the same as distance $D_2$.

Like the embodiment depicted in FIG. 1(*a*), in this exemplary embodiment, the first terminal end and the second terminal end are situated outside a center region of the hairpin defined between the first leg and the second leg.

As mentioned above, in exemplary embodiments such as that shown in previous figures and FIG. 2(*a*), a length of the third leg 201*c* is less than half a length of the first leg 201*a*, and a length of the fourth leg 201*d* is less than half a length of the second leg 201*b*; in preferred embodiments, the length of the smaller legs is substantially 45% the length of the longer leg. However, a different embodiment is shown in FIG. 2(*b*), wherein a length of the third leg 201*c* is greater than half a length of the first leg 201*a*, and a length of the fourth leg is greater than half a length of the second leg 201*b*. Although these embodiments provide for prongs configured to receive more hair strands therein, their ease with which each hairpin may be handled by a user is affected with the larger adjacent legs. Nevertheless, for certain hairstyles the larger configuration may be desirable.

Figure 3A:
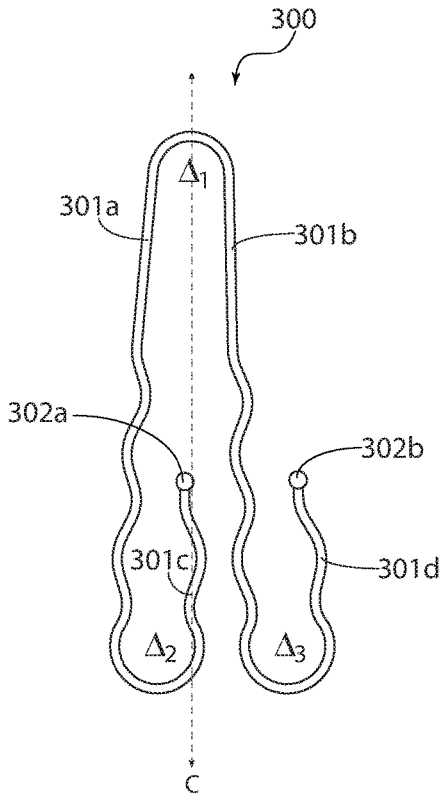
FIG. 3(*a*) illustrates a top view of a hairpin in accordance with one exemplary embodiment of the present invention.
Figure 3B:
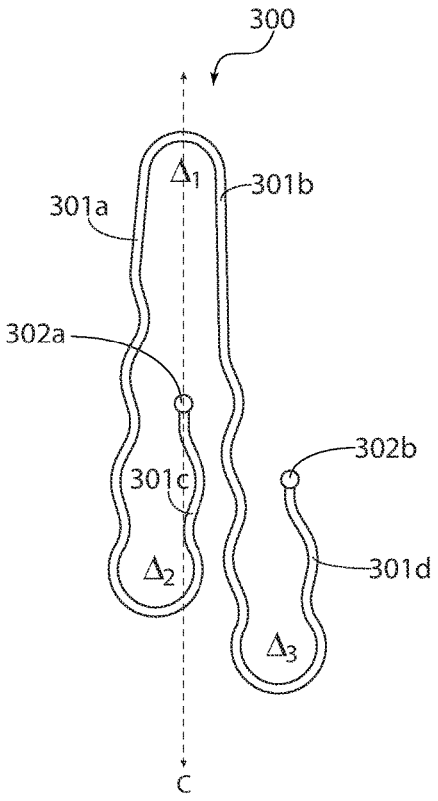

Turning next to FIG. 3(*a*), and FIG. 3(*b*), top views of similar hairpins in accordance with exemplary embodiments of the present invention are illustrated. More specifically, hairpin 300 is shown in alternative embodiments, formed of a wire having two terminal ends 302*a* and 302*b*. In each alternative embodiment, a primary prong is formed by legs 301*a* and 301*b* extending from a bend $\Delta_1$. As with the other embodiments discussed above, a second and third prong are respectively formed from legs 301*c* and 301*d* extending from (respectively) bends $\Delta_2$ and $\Delta_3$. In the exemplary embodiments of both FIG. 3(*a*) and FIG. 3(*b*), the second terminal end 302*b* is situated outside a center region of the hairpin defined between the first leg 301*a* and the second leg 301*b*, and the first terminal end 302*a* is situated inside the center region of the hairpin defined between the first leg 301*a* and the second leg 301*b*, generally within range of center line C.

As mentioned above, in exemplary embodiments such as that shown in previous figures, a length of the third leg is less than half a length of the first leg, and a length of the fourth leg is less than half a length of the second leg, so that more hair is secured within the prong and the hair may be more easily guided through the prong when the length of the leg is as such. In each of these embodiments, second bend $\Delta_2$ and third bend $\Delta_3$ may not be equidistant to the first bend $\Delta_1$ even though the bottom portions of legs 301*a* and 301*b* may have a similar length as in FIG. 3(*a*) or may have different lengths as in FIG. (b).

Figure 4A:
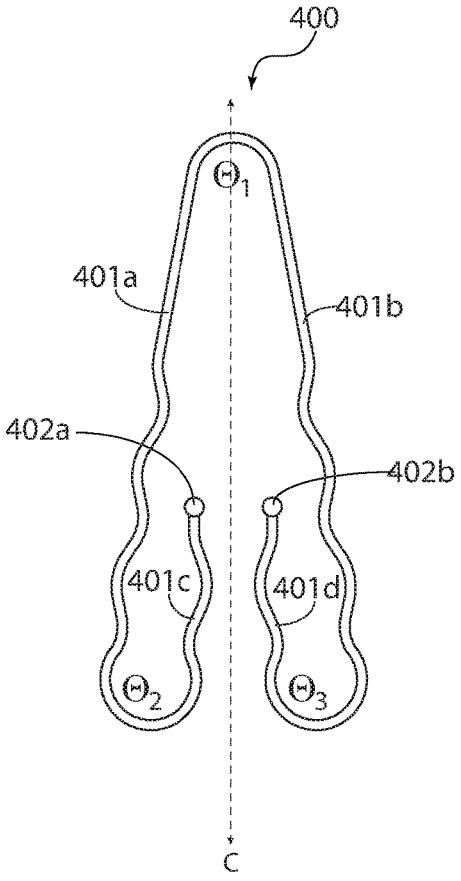
FIG. 4(*a*) illustrates a top view of a hairpin in accordance with one exemplary embodiment of the present invention.
Figure 4B:
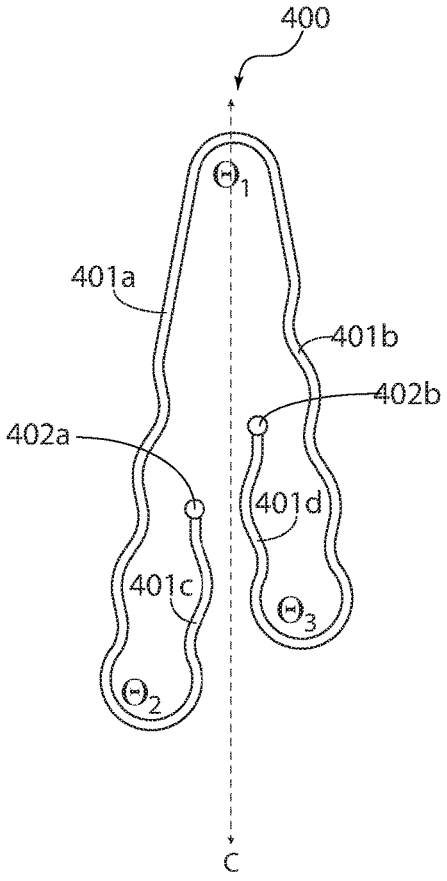

Turning now to the next set of figures, FIG. 4(*a*) illustrates a top view of a hairpin in accordance with one exemplary embodiment of the present invention, and FIG. 4(*b*) illustrates a top view of a similar exemplary embodiment. More specifically, hairpins 400 are formed of a wire having two terminal ends 402*a* and 402*b*, and generally comprise: a first prong defined by a first leg 401*a* and a second leg 401*b* extending from a first bend $\Theta_1$ on the wire; a second prong is defined by the first leg 401*a* and a third leg 401*c* extending from a second bend $\Theta_2$ situated opposite to the first bend $\Theta_1$. The third leg 401*c* terminates at terminal end 402*a*. The third prong is similarly defined by the second leg 401*b* and a fourth leg 401*d* extending from a third bend $\Theta_3$ situated opposite to the first bend $\Theta_1$, the fourth leg 401*d* also terminating at a terminal end of the wire, or terminal end 402*b*. Primarily, it may be noted that the embodiments depicted in these figures comprise hairpins in which the first terminal end 402*a* and the second terminal end 402*b* are similarly situated inside a center region of the hairpin defined between the first leg 401*a* and the second leg 401*b*, generally within range of center line C.

Figure 5:
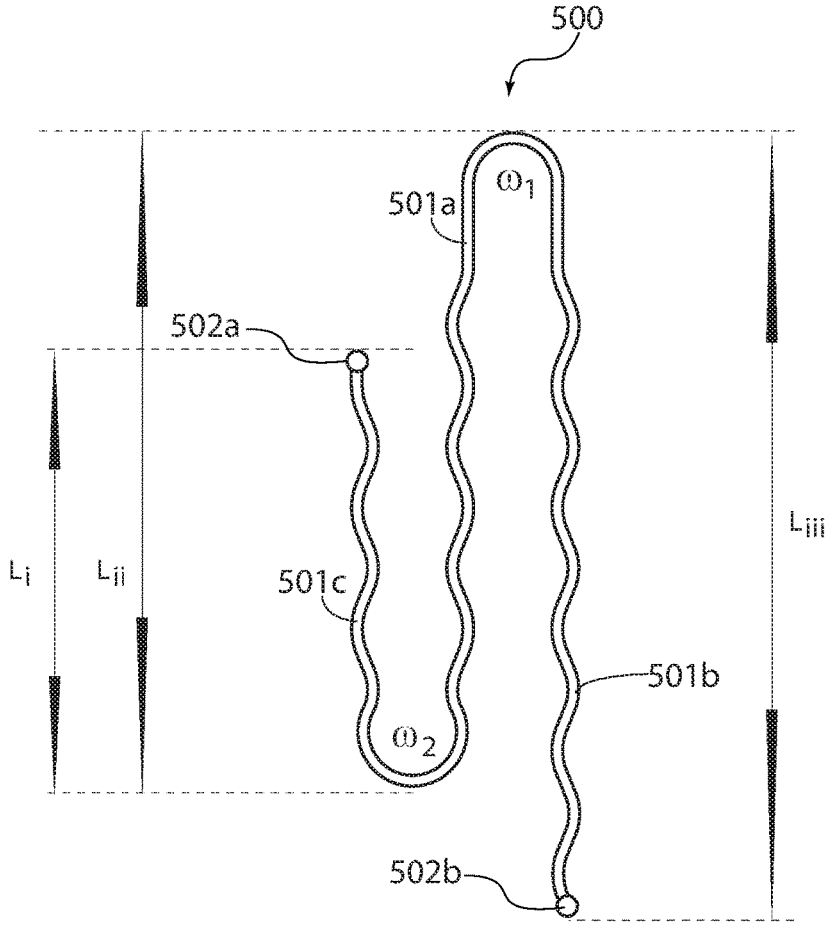
FIG. 5 illustrates a top view of a hairpin in accordance with one exemplary embodiment of the present invention.

Turning now to the next figure, FIG. 5 illustrates a top view of a hairpin in accordance with one exemplary embodiment of the present invention, in which only two prongs rather than three are formed from a single wire. In this embodiment, a hairpin 500 comprises a first prong defined by a first leg 501*a* and a longer second leg 501*b* extending from a first bend $\omega_1$ on the single wire of hairpin 500. Hairpin 500 further comprises a second prong that is defined by the first leg 501*a* and a third leg 501*c* extending from a second bend $\omega_2$ situated opposite to the first bend $\omega_1$. The third leg 501*c* terminates at terminal end 502*a*. Importantly, the length of third leg 501*c* must be long enough so that the second prong is useful for receiving enough hair strands in order to securely hold hairpin 500 in place. Although a smaller third leg may be useful for handling the device, a longer third leg actually helps to receive hair within the second prong and thus significantly increase the holding factor of hairpin 500. In exemplary embodiments, a length $L_i$ of leg 501*c* and a length $L_{ii}$ of leg 501*a* combined is greater than a length $L_{iii}$ of leg 501*b*, so that $L_i+L_{ii}$ is greater than $L_{iii}$. Moreover, because leg 501*c* is sufficiently long, a wavy region may be implemented in order to improve the receiving of hair strands within the second prong of hairpin 500.

Rather than implementing an additional prong, leg 501*b* terminates at terminal end 502*b*. Although additional prongs add to the securing or grasping factor of a hairpin in accordance with the resent invention, the embodiment depicted in hairpin 500 has a desirable benefit of requiring less material and thus may be less costly to manufacture.

Figure 6A:
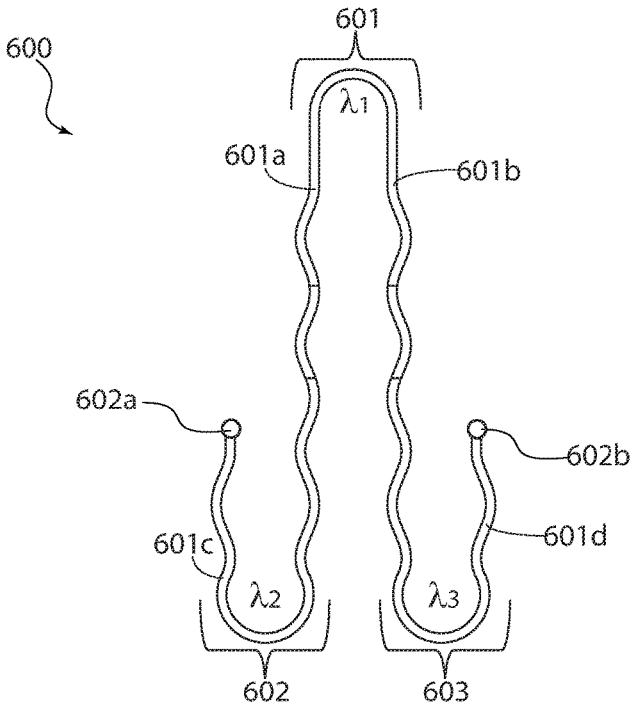
FIG. 6(*a*) illustrates a top view of a hairpin in accordance with one exemplary embodiment of the present invention.
Figure 6B:
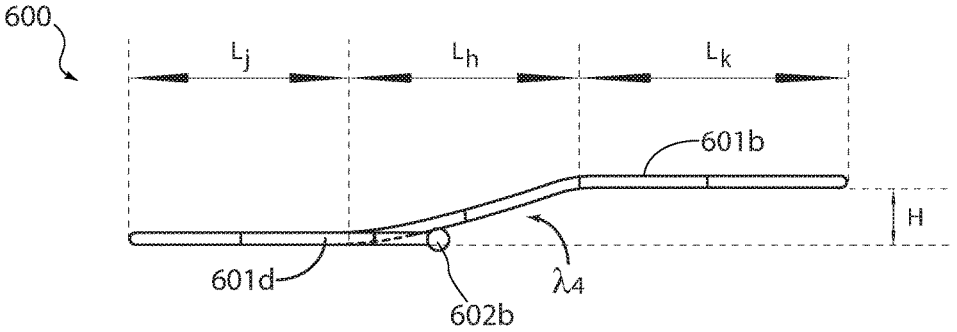

Now turning to the next set of figures, FIG. 6(*a*) illustrates a top view of a hairpin in accordance with yet another exemplary embodiment of the present invention. In this embodiment, hairpin 600 is typically formed of a single wire and includes several prongs 601, 602 and 603. A first prong 601 may be defined by a first leg 601*a* and a second leg 601*b* extending from a first u-shaped bend $\lambda_1$ on the wire. A second prong 602 may be defined by the first leg 601*a* and a third leg 601*c* extending from a second u-shaped bend $\lambda_2$ situated opposite to the first u-shaped bend $\lambda_1$. The third leg 601*c* terminates at terminal end 602*a*. A third prong 603 may be defined by the second leg 601*b* and a fourth leg 601*d* extending from a third u-shaped bend $\lambda_3$ situated opposite to the first u-shaped bend $\lambda_1$, the fourth leg 601*d* also terminating at a terminal end of the wire, or terminal end 602*b*. Although similar from a top view to previously discussed embodiments, in this embodiment, sections of the first prong 601 (i.e. along lengths $L_h$ and $L_k$) are on a different plane than the second prong 602 and the third prong 603, which share the same plane with each other and the section of the first prong along length $L_j$. FIG. 6(*b*) illustrates a side view of hairpin 600.

In FIG. 6(*b*) it may be appreciated that a portion of leg 601*b* of prong 601 is situated at a height H in relation to the other prongs 602 and 603; leg 601*d* of prong 603 visibly below a portion of leg 601*b*. As is easily appreciated from the side view of FIG. 6(*b*), this is accomplished by implementing a slant along a length $L_h$ of legs 601*a* and 601*b* in order to form an angle $\lambda_4$ that is generally acute with respect to the plane on which prongs 602 and 603 are situated. Moreover, a portion of legs 601*a* and 601*b* that are closer to the first u-shaped bend $\lambda_1$ are substantially parallel with third leg 601*c* and fourth leg 601*d*.

Figure 7:
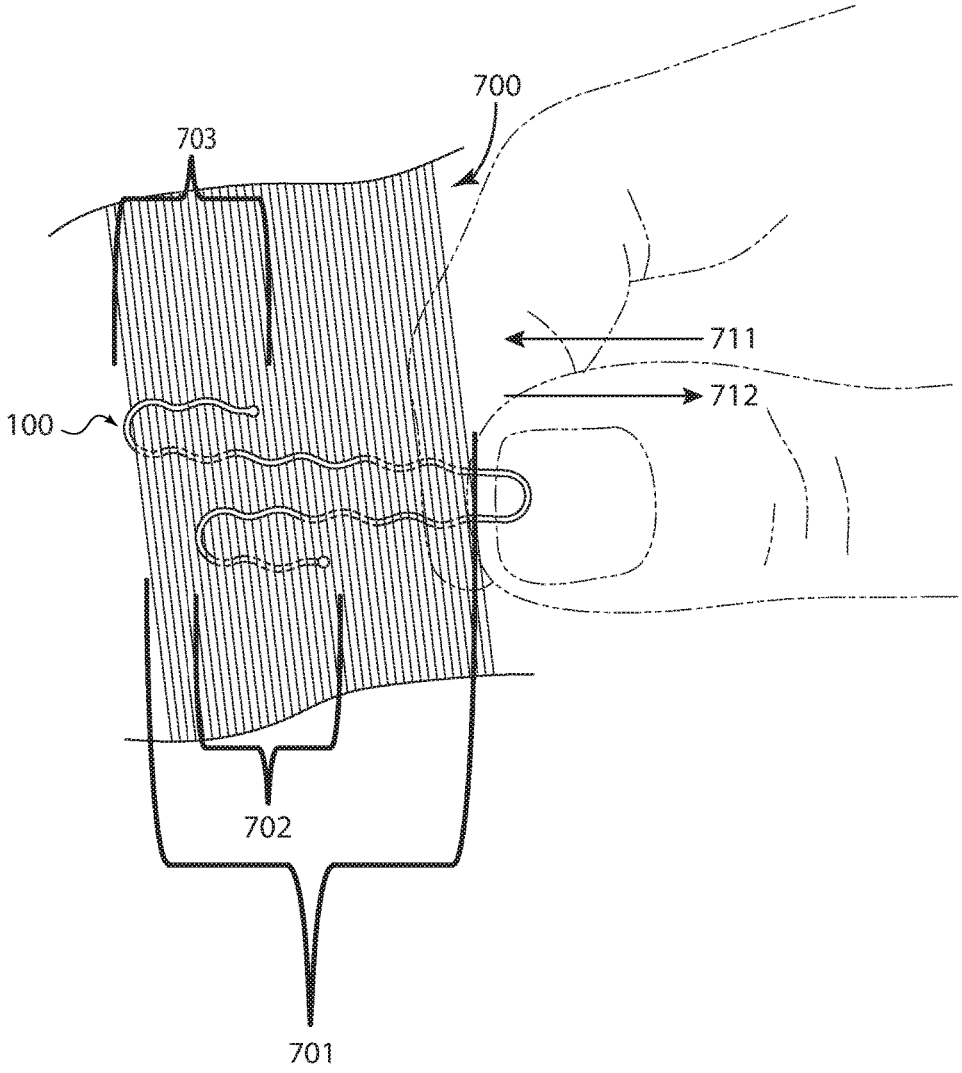
FIG. 7 illustrates a hairpin in accordance with the present invention securely capturing different strands or levels of hair.
Figure 8:
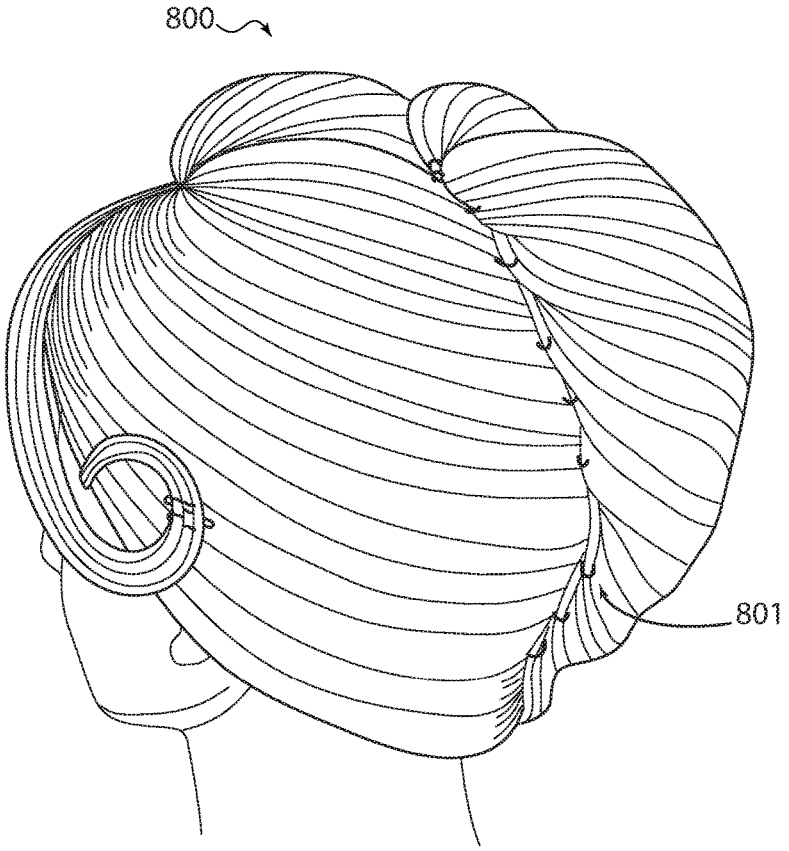
FIG. 8 illustrates a plurality of hairpins in accordance with the present invention securing a hairstyle of a wearer.

Moving on now to the remaining figures, FIG. 7 and FIG. 8 depict how a device in accordance with the present invention may be utilized or placed within a wearer's hair in order to secure a particular hairstyle.

As may be appreciated by a person of ordinary skill in the art, there are several ways and methods of using a hairpin. However, a hairpin in accordance with the present invention may be used in one or more unique ways in order to maximize the utility of a device in accordance with the present invention. For example, FIG. 7 illustrates a hairpin in accordance with the present invention securely receiving various levels of multiple strands of hair within in its several prongs. This may be accomplished, by way of example and without limiting the invention, by first inserting hairpin 100 in a direction 711 with the smaller prongs 102 and 103 of hairpin 100 at the forefront or into the section of hair 700 in which hairpin 100 will be introduced. Because prongs 102 and 103 face an opposite direction than prong 101 of hairpin 100, hairpin 100 is not easily removed. In order to further secure hairpin 100 in place, it may be pulled back slightly in direction 712 in a manner so that hair strands situated at u-shaped bends $\Phi_2$ and $\Phi_3$ tightly fit hair strands therein. In some situations, moving hairpin 100 back and forth in directions 711 and 712 may be helpful until a desired location of hairpin 100 is suitably secured thereby holding a particular hairstyle in place. As with the hair strands secured within bends $\Phi_2$ and $\Phi_3$, this motion may help similarly secure hair strands within bend $\Phi_1$.

It may also be appreciated from this view that different sections of hair including multiple hair strands are interlaced within the legs of the several prongs of hairpin 100. For example, prong 101 may secure most of the hair strands within section 701; prong 102 holds only a smaller section 702 of the hair strands; and prong 103 holds hair strands in section 703 not held by either of the other prongs. Also, some of the hair strands are held within every one of the prongs; this configuration allows for hairpin 100 to be more secured within hair section 700, as the differently situated legs of the device make it more difficult for hairpin 100 to slip out of the hair during activities such as dancing or moving around. That is, the different orientation of the prongs prevent hairpin 100 from sliding out as the user moves around.

As a person of ordinary skill in the art will appreciate, multiple hairpins like those described above may be implemented into a hairstyle. FIG. 8 illustrates a plurality of hairpins in accordance with the present invention securing a hairstyle of a wearer.

An improved hairpin has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A hairpin formed of a wire having two terminal ends, comprising:

a first prong defined by a first leg extending from a first vertex of a first u-shaped bend on the wire to a second vertex of a second u-shaped bend on the wire, a second leg extending from the first vertex to a third vertex of a third u-shaped bend on the wire, and a first gap extending from the first vertex throughout an entire length of the first prong;

a second prong defined by the first leg and a third leg extending from the second u-shaped bend situated opposite to the first u-shaped bend, the third leg terminating at a first terminal end of the wire, and a second gap extending from the second vertex to the first terminal end; and a third prong defined by the second leg and a fourth leg extending from the third u-shaped bend situated opposite to the first u-shaped bend, the fourth leg terminating at a second terminal end of the wire, and a third gap extending from the third vertex to the second terminal end, wherein:

a distance between the second vertex and the first vertex is less than a distance between the third vertex and the first vertex;

the first u-shaped bend, the second u-shaped bend and the third u-shaped bend are situated on a single plane;

the first leg, the second leg, the third leg and the fourth leg are parallel and situated on the single plane, and the first terminal end and the second terminal end are situated outside a center region of the hairpin defined between the first leg and the second leg.

2. The hairpin of claim 1, wherein a length of the third leg is less than half a length of the first leg, and a length of the fourth leg is less than half a length of the second leg.

3. The hairpin of claim 1, further comprising a wavy region along a length of each of the first leg, the second leg, the third and the fourth leg.

4. The hairpin of claim 1, wherein the first terminal end and the second terminal end of the wire comprise rounded terminal ends.

5. The hairpin of claim 1, wherein the wire includes an anti-slip surface.

6. The hairpin of claim 1, wherein the wire comprises a rounded cross-section.

7. The hairpin of claim 1, wherein the wire comprises a polygonal cross-section.

8. A hairpin formed of a wire having two terminal ends, comprising:

a first prong defined by a first leg including a first wavy region and a second leg including a second wavy region, the first leg and the second leg extending from a first u-shaped bend on said wire, a length of the second leg greater than a length of the first leg, the first prong further defined by a first gap between the first leg and the second leg extending from a first vertex of the first u-shaped bend throughout an entire length of the first prong;

a second prong defined by the first leg and a third leg extending from a second u-shaped bend situated opposite to the first u-shaped bend, the third leg including a third wavy region and terminating at a first terminal end of the wire, the second prong further defined by a second gap between the first leg and the third leg; and a third prong defined by the second leg and a fourth leg extending from a third u-shaped bend situated opposite to the first u-shaped bend, the fourth leg including a fourth wavy region and terminating at a second terminal end of the wire, the third prong further defined by a third gap between the second leg and the fourth leg, wherein:

the first u-shaped bend, the second u-shaped bend and the third u-shaped bend are situated on a single plane;

the first leg, the second leg, the third leg and the fourth leg are parallel and situated on the single plane;

a distance from a second vertex of the second u-shaped bend to the first vertex of the first u-shape bend is less than a distance from a third vertex of the third u-shaped bend to the first vertex of the first u-shape bend; and the first terminal end and the second terminal end are situated outside a center region of the hairpin defined between the first leg and the second leg.

9. The hairpin of claim 8, wherein the first terminal end and the second terminal end of the wire comprise rounded terminal ends.

10. The hairpin of claim 8, wherein the wire includes an anti-slip surface.

11. The hairpin of claim 8, wherein the wire comprises a rounded cross-section.

12. The hairpin of claim 8, wherein the wire comprises a polygonal cross-section.

* * * * *